United States Patent [19]

Monninger

[11] 3,985,295

[45] Oct. 12, 1976

[54] HEAT COLLECTOR AND DIFFUSER

[76] Inventor: Robert C. Monninger, 110 N. Coolidge, Normal, Ill. 61761

[22] Filed: Mar. 17, 1975

[21] Appl. No.: 559,170

[52] U.S. Cl. ..... 236/38; 98/40 C; 165/122

[51] Int. Cl.[2] ..... F24F 11/08

[58] Field of Search ..... 236/38, 49; 98/40 C; 165/53, 55, 122, 137

[56] References Cited

UNITED STATES PATENTS

| | | | |
|---|---|---|---|
| 2,054,071 | 9/1936 | Cummings | 236/38 |
| 2,692,759 | 10/1954 | Swenson et al. | 165/122 X |
| 3,035,760 | 5/1962 | Simmons | 165/122 X |
| 3,267,255 | 8/1966 | Schulz | 165/122 X |
| 3,674,203 | 7/1972 | McGrath | 236/38 |
| 3,799,248 | 3/1974 | Wenig | 98/40 C X |
| 3,804,257 | 4/1974 | Wenig | 98/40 C X |

FOREIGN PATENTS OR APPLICATIONS

| | | | |
|---|---|---|---|
| 1,375,169 | 11/1974 | United Kingdom | 236/38 |

*Primary Examiner*—William E. Wayner
*Assistant Examiner*—William E. Tapolcai, Jr.
*Attorney, Agent, or Firm*—Fitch, Even, Tabin & Luedeka

[57] ABSTRACT

A heat collector and diffuser is disclosed for superimposition over elongated fin tube radiators in building heating systems. Blower means induces airflow across an elongated fin tube heat exchanger and into collector ducts which channel the heated air into a diffuser area where the blower means forcefully discharges the heated air into the roomer space. In this manner, inefficient and out-of-date heating systems may be improved and modernized without substantial changes or modifications.

7 Claims, 3 Drawing Figures

HEAT COLLECTOR AND DIFFUSER

This invention relates generally to apparatus adapted for existing heating system installations which use fin tube radiators or heat exchangers as the primary means for room temperature control.

Fin tube heat exchangers, having a central passage for the flow of hot water or steam and metallic fins for the conduction of heat therefrom, have long been used for commercial and residential heating. Typically, they are located along one side of the room or space to be heated. Hot water or low pressure steam is piped through a central tube portion of the heat exchanger and the heat therein is conducted outwardly by the series of thin metallic fins which extend radially from the center tubular portion. Heat is then transferred to the atmosphere by natural convection, which is the air movement across the heated fins caused by the rising of hotter air adjacent the fins and the subsequent movement of cooler air into the area displaced by the rising hot air.

Although fin tube heat exchangers are found in heating systems in a variety of buildings, the present invention is of particular advantage in respect to fin tube radiators used for heating small residential spaces such as the rooms found in typical college dormitories. Fin tube radiator heating systems for such residential areas suffer a number of disadvantages. Firstly, natural convection heating is a very slow method of establishing a minimum ambient air temperature within a room or space. The room can only be heated as quickly as the natural tendency of hot air to rise from the area adjacent the fins causes sufficient drafts and air movement within the room to establish the desired temperature throughout. Often, the air cools before it reaches more distant parts of the room, and differential heating, lower air temperature in those portions of the room remote from the heat exchanger and normal or above normal temperature in the areas nearer the exchanger, results. The temperature within even a small area can vary as much as 10° Fahrenheit. To establish a comfortable temperature in more remote areas of a room often requires using hotter water or steam in the heat exchanger, which in turn causes an overheating of those portions of the room nearer the exchanger. These problems are even further complicated when there are significant external heat sources such as electrical lighting, sunlight, or human occupancy which can significantly affect not only the need for room heating but also the disparity in room temperature from one part of the room to another. The inefficiency of natural convection also has a high energy cost, the higher radiator temperatures necessitating greater use of fuel to sufficiently heat the hot water or steam which is piped through the system. Often, modifications to improve efficiency are costly and involve substantial demolition and reconstruction.

Another disadvantage with heating systems which utilize fin tube radiators is the lack of adequate means to effectively control the temperature of the radiator or the amount of heat that flows from it. In many systems which have been installed, a simple on-off valve is provided upstream of the radiator and limits control to either a full-heat or no-heat situation. In some older installations, there is virtually no individual control over the heat input to a specific area and a main control valve controls the flow of hot water or steam to a number of different rooms or spaces.

Accordingly, an object of this invention is to provide a heat collector and diffuser which may be used to easily modernize and improve existing heating systems utilizing fin tube heat exchangers.

Another object of this invention is to provide a heat collector and diffuser for co-operation with heating systems of the aforementioned type which will increase the distribution of heat from the heat exchanger into the room atmosphere and provide a more uniform temperature in the space or room while effecting a savings in fuel and energy costs.

A further object of this invention is to provide a heat collector and diffuser of the kind discussed which gives the room occupant a finer degree of environmental temperature control.

These and other objects of the invention are more particularly set forth in the following description and in the accompanying drawings of which:

Figure 1:
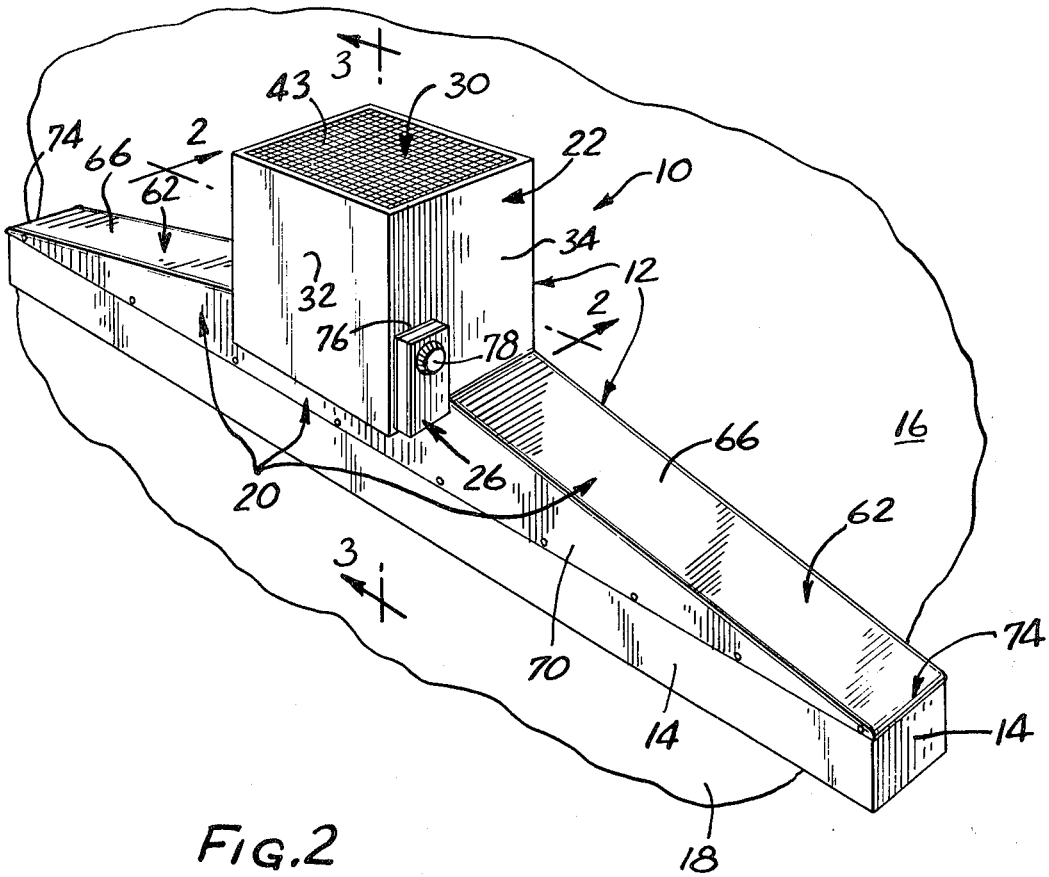
FIG. 1 is a perspective view of a heat collector and diffuser having various features of the invention, showing it mounted on a fin tube heat exchanger in a previously erected heating system.
Figure 2:
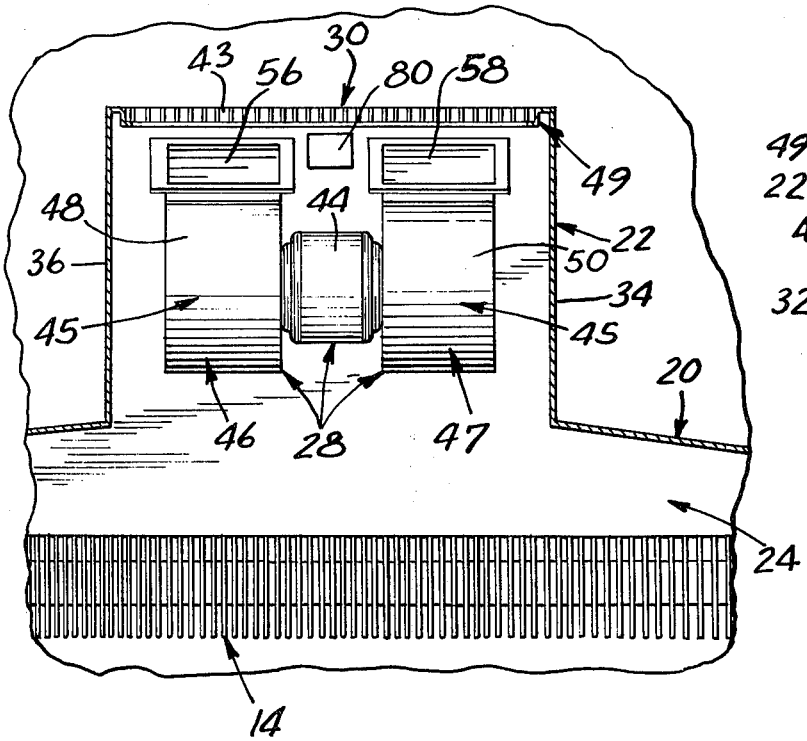
FIG. 2 is a partial front view of a heat collector and diffuser of FIG. 1, in section.

Turning now in more detail to the FIGURES, the present invention is embodied in a heat collector and diffuser apparatus 10, shown generally in FIG. 1, which does not have a heating element itself, but is adapted for superimposition over an elongated fin tube radiator or heat exchanger 14, as is generally found in dormitory room heating systems, to improve the distribution of heat therefrom while effecting overall fuel savings, and which may be installed without requiring substantial modification or changes in the system. A simple housing means 12 may be placed upon an existing radiator or heat exchanger 14 and may be secured thereto or may be secured to an adjacent wall 16 or floor 18. A collector duct 20 extends from a central blower section 22 substantially across the entire length of the radiator or heat exchanger 14, and has a longitudinal bottom inlet air means 24 for nesting therewith. As determined by thermostatic control means 26, forced hot air distribution is provided by a blower means 28 which draws air upwardly across the underlying fin tube heat exchanger 14, increasing the transfer of heat therefrom as compared to natural convection, and into the collector duct 20 which channels the air to the central blower section 22 where the blower means 28 forcefully discharges the heated air upwardly through an outlet means 30 in the blower section. When the blower means 28 is off, the collector duct 20 acts to restrict natural convection and prevent overheating of those areas near the heat exchanger or radiator.

Figure 3:
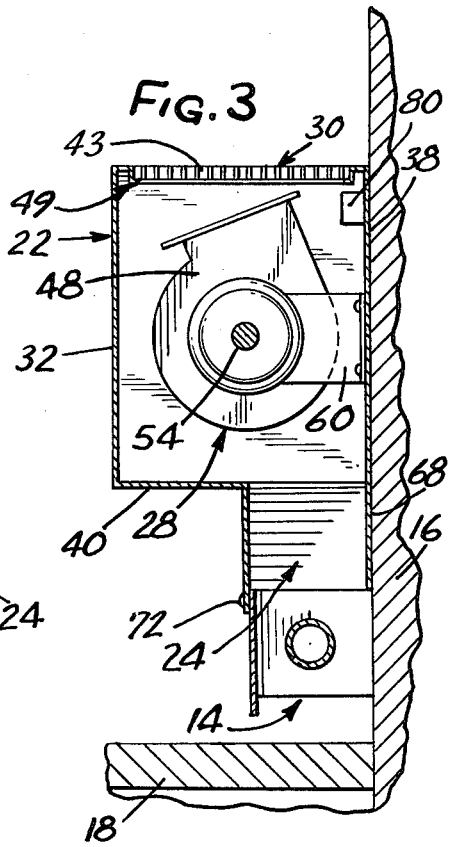
FIG. 3 is a side view of a heat collector and diffuser of FIG. 1, also in section.

The housing means 12 is generally fabricated of sheet metal, aluminum, or other suitable material, and, of course, may be finished by painting, or the like, to suit the decor of the particular room or space. For enclosing the blower means 28 and for providing the outlet means 30 for heated air, the housing 12 includes the upstanding central blower section 22 which is generally of quadrilateral parallelpiped shape, with a front panel 32, side panels 34 and 36 and a rear panel 38. The panels may be formed from a single piece of sheet metal or like material or may be cut individually and attached together by well-known means such as soldering or welding. A partial bottom panel 40, as can best be seen in FIG. 3, encloses only a forward portion of the bottom of the blower section 22, and defines a rearward inlet opening 42 which co-operates with the collector duct 20 for channeling heated air into the blower section. A grillwork section 43 covers the air outlet means 30 in the top of the blower section 22 and is supported by the uppermost marginal edges, indicated generally at 49, of the blower section panels 32, 34, 36 and 38, the edges being inturned to form a supporting ledge allowing the grill to be lifted therefrom for access to the blower means 28. The grillwork section 43 is comprised of serially intersecting spline members, well-known in the art, which allow the flow of air vertically between them while protecting against accidental contact with the blower means therebelow.

The blower means 28 is provided for drawing air upwardly through the fin tube heat exchanger 14 and for exhausting it through the grillwork section 43. It is preferably located within the central blower section 22, and includes an electric motor 44 for driving a fan means 45. In the preferred embodiment, the fan means is comprised of two centrifugal fans 46 and 47 with the electric motor 44 positioned therebetween. The centrifugal fans 46 and 47 each includes a spiral housing, 48 and 50 respectively, with a squirrel-cage impeller (not shown) disposed within each for rotation therein in the direction of the outward spiral. The impellers are secured to a motor shaft 54 which extends horizontally from each side of the electric motor 44. Upon energization of the motor by the thermostat means 26, the impellers are rotated, creating a centrifugally outward force of air through upwardly pointed fan housing outlets 56 and 58 which direct the airflow through the grillwork section 43. Large openings are provided in the side of each fan housing to accommodate the influx of air into the housing caused by suction arising from the exhaust of air through the outlets 56 and 58. Bracket means 60 are attached to the rear panel 38 of the blower section 22 and support the motor 44 and the centrifugal fans 46 and 47 therein.

The suction, or lower air pressure, created within the blower section 22 by the exhaust of air therefrom by the fans 46 and 47 draws air upwardly through the bottom inlet opening 42. To channel this air flow across the underlying fin tube radiator 14, the collector duct 20 depends from the perimeter of the bottom opening 42 in the central blower section and includes outrigger portions 62 which are adapted for superimposition over the elongated fin tube heat exchanger or radiator 14. The inlet air means 24 is defined along the bottom of substantially the entire length of the downward opening collector duct 20 which includes top panels 66 which flare outwardly from the lower marginal edges of the side panels 34 and 36 of the blower section 22, a generally triangular rear wall 68 which extends downwardly from the rear panel 38 and a generally triangular front wall 70 which depends from the rear edge of the partial bottom panel 40. In this manner, the collector duct 20 can be nested immediately above the heat exchanger 14, the suction drawing air upwardly across the fins for heating and into the inlet air means 24 of the duct, the heated air then being channeled into the blower section 22 via the bottom opening 42 therein. As can best be seen in FIG. 3, the front wall 70 may include a lip portion 72 which overhangs in front of the heat exchanger 14, so that air drawing upwardly into the duct opening 24 will be forced to pass across at least a portion of the heated fins of the radiator. If the radiator is sufficiently above floor level for adequate air circulation, the lip portion 72 may be extended downwardly so as to completely block the front of the exchanger 14, as shown in phantom in FIG. 3, and result in air being drawn upwardly across substantially the complete height of the radiator with a consequent increase in heat transfer from the fins over that obtained from a partial lip. A fully extending lip also has the advantage of protecting against burns or injury by preventing human contact with the heated radiator.

In the preferred embodiment, the outrigger portions 62 taper toward the end of the heat exchanger 14. This feature is not only more aesthetic in reducing bulky appearance of the unit but also saves material cost over a design where the collector duct 20 is of uniform height across the radiator. To accommodate a nesting relationship between the collector duct 20 and the radiator 14, each outer end of the top panels 66 is bent to form a flat horizontal flange portion 74 for resting or seated engagement upon the upper surface of the underlying radiator 14 near each end thereof. This allows the radiator to support a portion of the weight of the heat collector and diffuser which may, in addition, be attached to an adjacent wall via the rear panel 28 by screws or other fastening devices (not shown).

The thermostat control means 26 is provided to control the energizing of the blower means 14, and may be located on one side of the blower section 22 as illustrated in FIG. 1. Insulation means 76 insulated the thermostat means from heat transfer from the blower section 22. The thermostat control means includes a temperature switch 78 which may be preset to the desired room temperature for energization of the motor 44 if the room temperature falls below the presetting. These thermostats are well-known, and one having a variable temperature range of 60° to 80° F. would suffice for most occupied rooms or spaces. A speed controller 80 interior the blower section 22, and accessible through the grillwork section 42, further controls the blower means by regulating the speed of the motor 44 in proportion to the difference between the measured room temperature and that selected by the occupant on the temperature switch 78. That is, the larger the difference between the actual room temperature and the desired room temperature, the faster the motor and fans will turn with a resultant increase in the volume of hot air exhaust into the room.

Having described the elements of the illustrated embodiment of this invention, its operation can now be summarized. The heat collector and diffuser apparatus described here is designed as a single unit to be installed in a nesting relationship over existing fin tube heat exchangers or radiators 14 typically found along the wall of small residential or college dormitory rooms in buildings utilizing a natural convection heating system. The apparatus may rest directly upon the radiator although it may also be secured to the adjacent wall or floor. Electrical power may be simply provided through an extension cord (not shown) to the nearest wall outlet. After the apparatus is installed, the room occupant need only select the desired temperature on the temperature switch 78. If the room air temperature falls below the setting, the thermostat means 26 energizes the motor 44 located within the blower section 22 of the housing means 12. Centrifugal fans 46 and 47 driven by the motor suck air upwardly across the underlying radiator for heating and into the bottom inlet air means 24 in the collector duct 20 which then channels the heated air into the central blower section. The heated air is then forcefully exhausted through the outlet grillwork section 43 and into the room or space. A speed controller 80 also cooperates to limit the speed of the motor 44 and thus to regulate the quantity of air flow through the outlet grill section in proportion to the difference between the actual room temperature and the desired room temperature as set on the temperature switch. After the room or space has reached the desired temperature, the thermostat means de-energizes the motor until the room again cools below the desired temperature.

As can be seen from the above description, the present invention provides an excellent means for modernizing and improving existing heating systems which utilize natural convection heating from fin tube heat exchangers. The device, built as a unit, may be installed over the existing radiator without any significant change or adjustment in the heating system itself. The unit may rest upon the radiator or may be attached to adjacent walls or floors. It further needs only to be connected to a power supply such as a wall outlet by a simple extension cord. The occupant of the room can set the desired temperature of the room on the thermostat on the unit, which will then substantially control the temperature of the room according to those needs. The forced hot air exhaust circulates much better than a natural convection air current and provides a substantially uniform temperature throughout the space or room in question. Also, the drawing of air across the radiator increases the transfer of heat therefrom which allows it to be operated at temperatures lower than those required for adequate natural convection heating, resulting in fuel savings from the reduction in quantities of coal, electricity or natural gas required to heat the steam or hot water which is circulated through the fin tube heat exchanger. When the room or space does not need additional heating, the collector ducts operate to restrict natural convection currents which could overheat portions of the room or space near the radiator. This apparatus is in effect an easy and simple way to rejuvenate and improve existing heating systems in buildings, homes and dormitories which utilize fin tube radiators and natural convection heating.

Various features of the invention are set forth in the following claims.

What is claimed is:

1. A heat collector and diffuser apparatus for installation over an existing room heating system employing elongated fin tube radiators for controlling the distribution of heat therefrom and for providing a more uniform environmental heating of the room or space, said apparatus comprising:

housing means adapted to be placed over said elongated radiator in nested relationship thereto, said housing means having an outlet means for exhausting air to the room at the upper end of said housing means, said housing means enclosing the upper portion of said radiator and excluding outside air, blower means associated with said housing means for inducing air flow across said fin tube radiator and through said housing for exhausting said air flow through said outlet means, thermostat means for controlling said blower means in accordance with a desired room temperature, and elongated collector ducts on said housing means for nesting superimposition over and for resting on an elongated fin tube heat exchanger for collecting air flowing across said fin tube radiator and an inlet means associated with said collector ducts for disposition substantially across the fin tube radiator to collect hot air thereacross as induced by said blower means to flow into and through said collector ducts to said blower means.

2. The apparatus of claim 1 in which said blower means is located within said housing means and comprises fan means and electric motor means for driving said fan means, said fan means adapted to discharge said air flow through said outlet means and to induce said air flow across said fin tube radiator and through said inlet means.

3. The apparatus of claim 1 in which said thermostat means includes a room air temperature switch having a selective presetting for energizing said blower means if the room air temperature falls below said presetting on said room air temperature switch.

4. The apparatus of claim 3 in which said thermostat means includes a control means for controlling the speed of said fan means so as to vary the quantity of said air flow proportionately with the difference between the room air temperature and said presetting on said room air temperature switch.

5. A heat collector and diffuser apparatus for use with room heating systems employing elongated fin tube radiators for controlling the distribution of heat therefrom and providing a more uniform heating of the room or space, said apparatus comprising:

housing means having lower inlet means and upper outlet means, said housing means including a central upright blower section with a top and a bottom, said upper outlet means provided in said top and a bottom opening provided in said bottom. a tapered outrigger collector duct depending from said bottom of said upright section and extending beyond each side thereof for overlying substantially the length of said fin tube radiator, electric blower means disposed within said upright section, said blower means directed to discharge air through said outlet means and adapted to suction air into said bottom opening, thermostat means co-operative with said electric blower means for selective energization thereof, said outrigger collector ducts co-operative with said bottom opening of said upright blower section for channeling air therethrough, and walls on said outrigger ducts defining an elongated opening in the bottom thereof to receive in nesting relationship substantially the entire length of said fin tube radiator for drawing air across said radiator and for channeling said air into said central upright blower section for forced exhaust by said electric blower means through said outlet means and into the room or space.

6. The apparatus of claim 5 in which said collector duct includes portions thereon adapted for seated engagement upon said fin tube radiator.

7. The apparatus of claim 5 in which said collector duct has a front lip portion which overhands said radiator.

* * * * *